US005119144A

United States Patent [19]

Hada et al.

[11] Patent Number: 5,119,144

[45] Date of Patent: Jun. 2, 1992

[54] CLEANER PROVIDED IN A COPYING MACHINE

[75] Inventors: Yoshinobu Hada; Kazuyuki Fukui; Yoshihiro Hattori, all of Osaka, Japan

[73] Assignee: Minolta Camera Kabushiki Kaisha, Osaka, Japan

[21] Appl. No.: 387,488

[22] Filed: Jul. 28, 1989

[30] Foreign Application Priority Data

Jul. 29, 1988 [JP] Japan ..... 63-191100

[51] Int. Cl.[5] ..... G03G 21/00

[52] U.S. Cl. ..... 355/303; 15/1.51; 15/256.5; 355/296

[58] Field of Search ..... 355/269, 271-274'296-303, 355/305, 269; 118/652; 15/256.5, 256.51, 1.51

[56] References Cited

U.S. PATENT DOCUMENTS

| | | | |
|---|---|---|---|
| 3,572,923 | 3/1971 | Fisher et al. | 355/298 |
| 3,580,673 | 5/1971 | Yang | 355/306 |
| 3,780,391 | 12/1973 | Leenhouts | 355/303 X |
| 4,111,546 | 9/1978 | Maret | 355/297 |
| 4,363,070 | 12/1982 | Kisler | 361/212 |
| 4,483,610 | 11/1984 | Takada | 355/297 |
| 4,506,975 | 3/1985 | Shukuri et al. | 355/303 |
| 4,752,810 | 6/1988 | Schmidlin et al. | 355/303 |
| 4,786,943 | 11/1988 | Fukae et al. | 355/303 X |

FOREIGN PATENT DOCUMENTS

| | | | |
|---|---|---|---|
| 2439440 | 3/1975 | Fed. Rep. of Germany | 355/274 |
| 54-19754 | 2/1979 | Japan . | |
| 0016279 | 1/1983 | Japan | 355/296 |
| 0224369 | 12/1983 | Japan | 355/296 |
| 0280883 | 12/1987 | Japan | 355/296 |
| 63-177180 | 7/1988 | Japan . | |

*Primary Examiner*—A. T. Grimley
*Assistant Examiner*—J. E. Barlow, Jr.
*Attorney, Agent, or Firm*—Willian, Brinks, Olds, Hofer, Gilson & Lione

[57] ABSTRACT

A cleaner in a transfer section of a copying machine for cleaning a soil toner transferred from a photoconductive member and adhering to the surface of a transfer drum, which includes a cleaning device which electrically attracts and cleans the soil toner on the surface of the transfer drum and an electrode disposed at the interior surface of the transfer drum for weakening the electrostatic force between the soil toner and the surface of the transfer drum. The electrode disposed in the interior of the dielectric drum is movable.

5 Claims, 8 Drawing Sheets

CLEANER PROVIDED IN A COPYING MACHINE

BACKGROUND OF THE INVENTION

1. Field of the Invention

The present invention relates to a cleaner for removing toner that adheres to the surface of a transfer drum installed in copy machine and preferably installed in a full-color copy machine.

2. Description of the Prior Art

In full color copiers, a single copy is produced by sequentially developing several images formed on a photoconductive drum and sequentially transferring said developed images onto the same copy paper sheet. Thus, the copy sheet is maintained in touching contact with the photoconductive drum through several copy processing cycles. The developed image on the surface of the photoconductive drum is obtained by adhering toner to an electrostatic latent image formed on the surface of said photoconductive drum, and the electrostatic latent image is obtained by charging the entire surface of said photoconductive drum by means of a corona charger, and then exposing an original document image on the surface of said photoconductive drum.

The surface area of the photoconductive drum generally is greater than the surface area of the maximum permissible size original document. The surface of the photoconductive drum, therefore, has sections at both ends and at the front and back which are not exposed to light and to which large quantities of toner adhere during the developing process. After the developing process, the toner adhering to the aforesaid unexposed sections is transferred to the transfer drum (comprising the surface of which is formed by a dielectric film or grid of polyester or the like without an electrically conductive substrate) which comes into touching contact with the surface of the photoconductive drum, thereby soiling said transfer drum and causing surface soiling of the copy sheet (hereinafter referred to as "toner soiling").

Accordingly, copiers are provided with cleaning devices to prevent the occurrence of the aforesaid disadvantages. An example of a conventional cleaner is the air suction type cleaner which uses a fur brush. More specifically, toner is scraped off by an insulated brush roller (fur brush) disposed so as to be in contact with the rotating region of the transfer drum, said scraped toner being removed by suction provided by a high-suction capacity blower. In addition to the aforesaid construction, a discharging brush is disposed opposite the aforesaid brush roller within the transfer drum, said discharging brush controlling the deformation of the drum in contact with the brush roller as well as discharging the interior of the transfer roller during the toner scraping process.

In conventional type cleaners as described above, however, the construction greatly increases the size of the device due to the reliance on the cleaning capability supplied by the suction capacity of the blower, which also results in the disadvantages of increased copier size and cost, noisier operation, and dispersion of dust.

In addition, the discharging brush on the inside of the transfer drum improves cleaning capacity somewhat by weakening the electrical attraction of the toner electrostatically attracted to the surface of the drum. In the previously described example of a conventional device, however, adequate cleaning capability is not realized because the combined action of the cleaner and the discharging brush is inadequate.

SUMMARY OF THE INVENTION

A main object of the present invention is to provide a cleaner capable of cleaning away the toner which adheres to the cleaning member without increasing the noise of operation or inducing dust dispersion.

Another object of the present invention is to provide a cleaner of simple construction which is capable of reliably cleaning away the toner that adheres to a cleaned member which has a surface formed of a dielectric film or synthetic resin grid and is provided in a transfer drum installed in a full color copier.

These objects of the present invention are accomplished by providing a cleaned member having a movable surface formed of a dielectric film or synthetic resin grid, wherein a cleaning element cleans the toner adhering to said cleaned member by means of an electrostatic action, said cleaner being characterized by having an electrode disposed opposite the aforesaid cleaning element within the cleaning member.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

Figure 1:
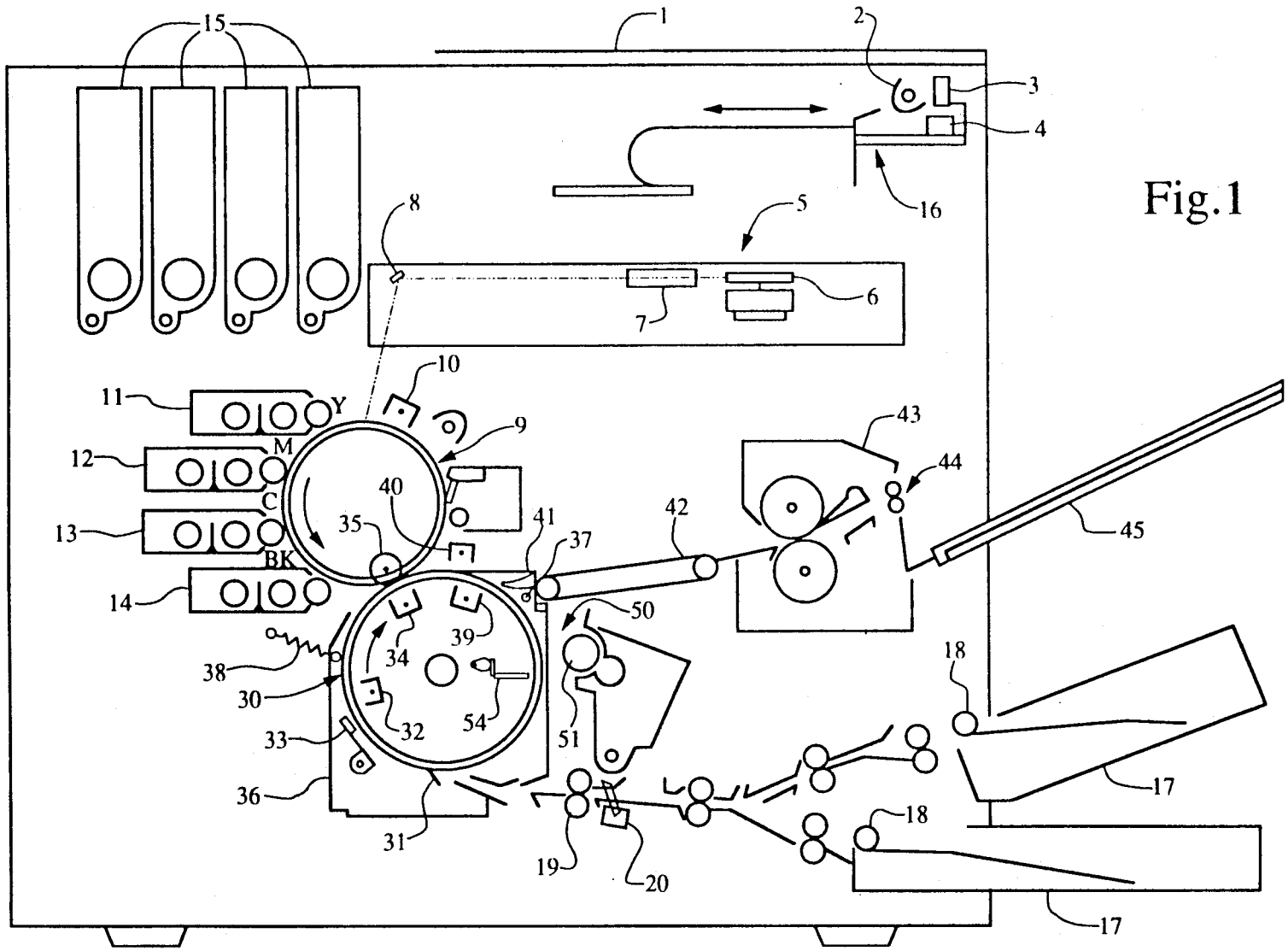
FIG. 1 is an elevational view in section of the construction of a copying machine having installed therein an embodiment of the cleaner of the present invention.

The construction of a full color copier is described hereinafter with reference to FIG. 1. When an original document is arranged on the document glass platen 1, exposure lamp 2 and SELFOC lens array 3 expose the original document so it can be read by a charge-coupled device (CCD) line sensor 4 as three color signals: R (red), G (green) and B (blue). The R, G and B color signals from the CCD line sensor 4 are converted to three or four value signals of Y (yellow), M (magenta), C (cyan) and possibly BK (black), which are output to a laser optical system 5. The full color copier does not have a trichromatic image memory, the image is scanned by a image reader unit 16 when each color image is formed and the resultant Y, M, C or Y, M, C and BK signals are sequentially transmitted to the laser optical system 5 based on the results of each scan.

Laser optical system 5 comprises a scanning polygon mirror 6, F $\theta$ lens 7 and reflecting mirror 8, which exposes the photoconductive drum 9 to a laser beam used for forming images in each color based on the aforesaid Y, M and C or Y, M, C and BK signals.

Photoconductive drum 9 is rotatably driven in the arrow direction indicated in the drawings. Photoconductive drum 9 comprises a drum formed by an electrically conductive substrate on the surface of which is superimposed an organic photoconductive member comprising sequentially formed charge generating layer and charge transporting layer, said photoconductive drum 9 has a high photosensitivity to laser light at wavelengths in the vicinity of 780 nm. The surface of photoconductive drum 9 is charged with a negative charge by means of a charger 10 disposed on the periphery thereof The image forming system of the aforesaid full color copier is an N-P (negative-to-positive) system. Thus, when the image portion is exposed to laser light, the image is developed by the negatively charged toner. At the left side of photoconductive drum 9 are fixedly mounted first, second, third and fourth developing units 11, 12, 13 and 14. Developing unit 11 supplies yellow toner, developing unit 12 supplies magenta toner, unit 13 supplies cyan toner, and unit 14 supplies black toner respectively, each color toner being negatively charged. Developing units 11, 12, 13 and 14 operate with a predetermined timing so as to sequentially form a yellow toner image, magenta toner image, cyan toner image, and black toner image on the surface of photoconductive drum 9, and subsequently electrostatically transfer the resultant image to the copy sheet on the transfer drum thereafter Above the each developing unit 11, 12, 13 and 14 are provided hoppers 15 which supply the corresponding color toner, said toners being supplied according to predetermined toner supply signals.

On the other hand, paper cassettes 17 disposed on the right side of the full color copier accommodate stacked regular paper or overhead projector transparencies (OHP film) or like transfer media, which are fed sheet by sheet to the interior of the copier by means of take-up rollers 18. When the leading edge of the sheet reaches the register roller 19, a loop is formed while simultaneously skew correction and front edge registration are accomplished. The aforesaid adjustments are accomplished by sheet sensor 20.

In front of register roller 19 is disposed a transfer drum 30 which is rotatable in the arrow direction indicated in the drawing. Transfer drum 30 is made of an aluminum drum frame with a surface formed of dielectric film or 50-80 mesh polyester grid. A plurality of leading edge check claws 31 are provided on said transfer drum 30 to check the leading edge of the transfer sheet fed thereto, so that when said leading edge check claws 31 check the transfer sheet, a charger 32 provided inside the transfer drum 30 negatively charges the drum surface, and an opposing electrode 33 disposed outside the drum comes into contact with the surface of the transfer sheet such that when the surface of the drum is charged, the surface of the transfer sheet is electrically grounded and said transfer sheet is electrostatically attracted to the transfer drum 30.

Thereafter, yellow toner developed by developing unit 11 is positively charged by a transfer charger 34 provided inside transfer drum 30, whereby the first transfer to a transfer sheet is accomplished. At this time the other developing units 12, 13 and 14 are in the non-developing state so as to not disturb the toner image formed by developing unit 11.

Transfer drum 30 and photoconductive drum 9 have provided therebetween a gap of approximately 0.3 to 0.7 mm. This gap is determined by the position output roller 35. That is, frame 36, which supports the transfer drum 30, is supported so as to be rotatable around bearing 37, and during image formation a pressure spring 38 presses said frame 36 to said position output roller 35, thus determining the aforesaid gap between the transfer drum 30 and photoconductive drum 9.

When the first transfer is completed, the surface of the drum is positively charged which causes the negatively charged transfer sheet to electrostatically adhere thereto, and the second transfer process is executed whereby the magenta toner image developed by developing unit 12 is then transferred to the transfer sheet. Thereafter, the transfer process is repeated the required number of times, and when the final transfer process is completed, the first and second dischargers 39 and 40 respectively provided inside and outside of transfer drum 30 electrically discharge the surface of said drum, whereupon a separation cam not shown in the drawing puts the leading edge chuck claw 31 in the non-chucked state.

Thus, the transfer sheet is separated from transfer drum 30 and passes the separating claw 41 to be delivered to the suction transport member 42. Then, the sheet is heat-roll fixed by fixing block 43, and thereafter discharged to discharge tray 45 by discharge roller 44 so as to produce the full color copy.

Although the previously described dischargers 39 and 40 both accomplish the electrical discharge of the transfer drum by means of an alternating current (AC) output, discharger 39 mainly reduces the electrostatic attractive force between the drum surface and the transfer sheet while discharger 40 mainly electrically discharges the surface of transfer sheet when separating said sheet from the drum as well as prevents discharge that accompanies separation to prevent image dispersion.

Figure 2:
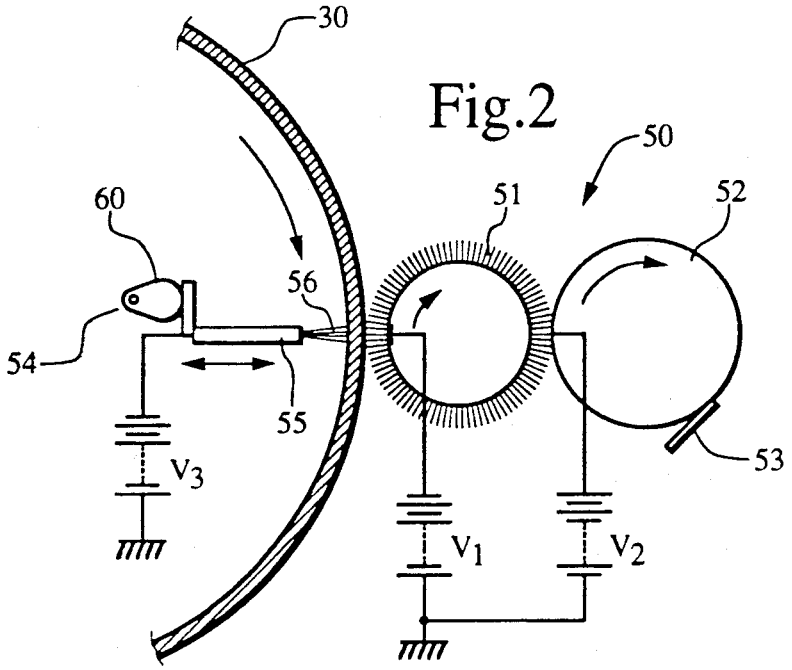
FIG. 2 is an elevational view in section showing the construction of the cleaner of the present invention.

The cleaner of the present invention is hereinafter described with reference to the accompanying FIG. 2 and FIGS. 3A and 3B. Cleaner 50 is provided on the downstream side of the previously described transfer process, i.e., below the separating claw 41 and suction transport member 42, as shown in FIG. 1. As shown in FIG. 2, cleaner 50 rubs the surface of transfer drum 30 during cleaning so as to scrape away soil toner which remains adhering to the drum surface after the transfer process. Cleaner 50 include an electrically conductive brush roller 51 which electrostatically attracts the soil toner disposed medially to the surface of the drum 30, a recovery roller 52, which collects said soil toner from the brush roller 51, and a scraper 53 which scrapes the collected soil toner from the surface of said recovery roller 52; and a charge reducing electrode 54 is provided on the inside of the drum surface.

Brush roller 51 has a bias voltage of electric potential $V_1$ (positive polarity) applied thereto which has a polarity opposite to that of the soil toner, and recovery roller 52 has a bias voltage of electric potential $V_2$ applied thereto which is higher than that applied to said brush roller 51. Accordingly, the electrostatically attracted soil toner scraped from the drum surface by brush roller 51 is attracted to and collected by recovery roller 52, which has a higher electric potential, at the point of contact between said brush roller 51 and recovery roller 52. Brush roller 51 and recovery roller 52 are pressed against and released from transfer drum 30 by means of a solenoid or the like which has a contact/release function and which is not shown in the drawings.

Electrode 54 functions to enhance the electrostatic attractive force of brush roller 51. That is, electrode 54 extends in conductive filaments 56 from the tip of metal substrate 55, and reciprocally moves right and left by a reciprocating motion means; a bias voltage of negative electric potential $V_3$ is applied thereto.

Figure 3A:
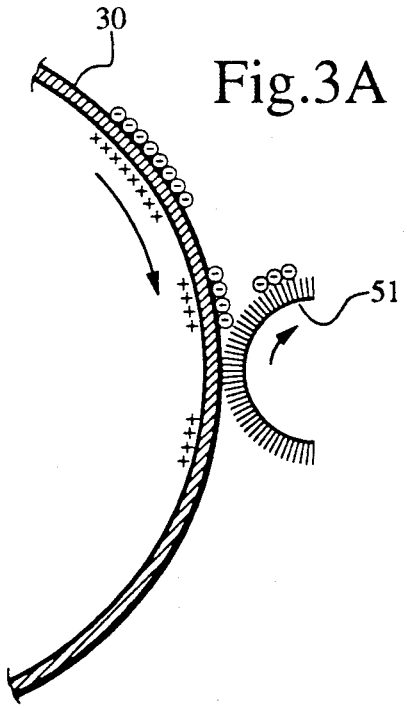
FIGS. 3A and 3B are elevational views in section showing the state of the electrode in the transfer drum.
Figure 3B:
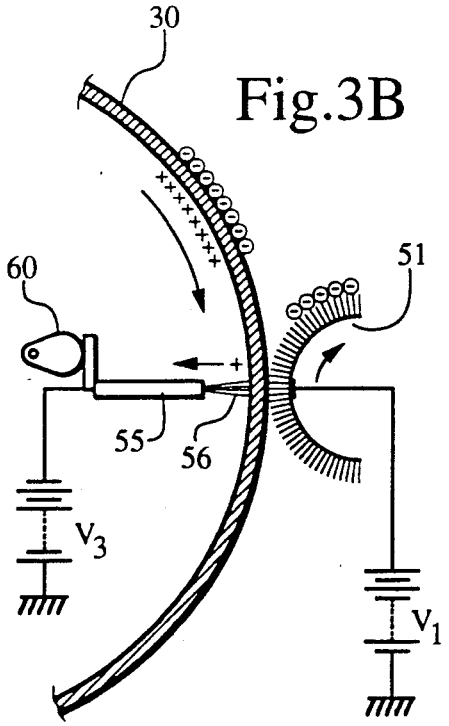

Following the previously described transfer process, the exterior surface of the transfer drum 30 possesses the polarity of the soil toner (negative polarity), as shown in FIG. 3A, while the interior surface of said drum possesses the opposite polarity (positive polarity). When the interior surface is touched by the filaments 56, the positive charge on the interior drum surface is discharged, as shown in FIG. 3B. Thus, the state of electrical equilibrium between the interior and exterior surfaces of the drum is disrupted, improving the electrostatic attraction (cleaning efficiency) of the brush roller 51 at that portion, so that the soil toner can be reliably cleaned therefrom.

The previously mentioned reciprocating motion means is herein described. As shown in FIG. 2, electrode 54 is normally kept apart from the interior surface of transfer drum 30 through the force applied by a spring or the like not shown in the drawings. Cam 60 moves said electrode 54 reciprocally to the right and left by rotating 180°. The aforesaid cam 60 rotates in correspondence with the cleaning timing so that during cleaning the electrode 54 is in the contact position shown in FIG. 2, while at non-cleaning times the electrode 54 moves leftward from the position shown in the drawing to the non-contact position.

Figure 4:
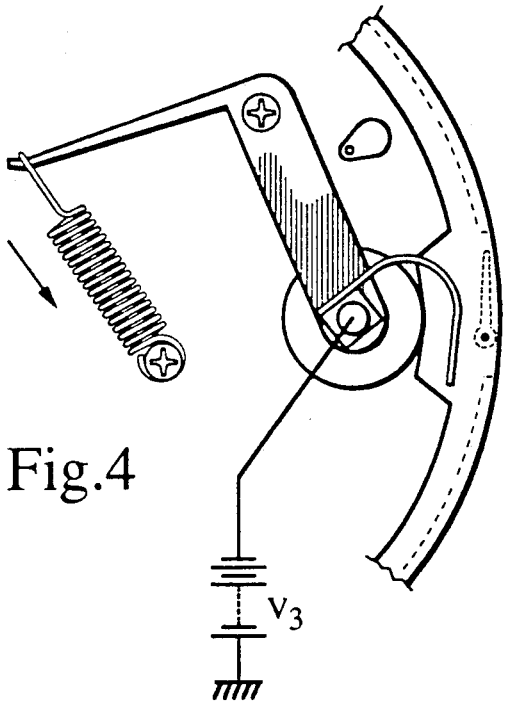
FIG. 4 shows an embodiment in which an electrode plate is substituted for the electrode in the embodiment of FIG. 2.

Contact by filament 56 is made only during cleaning, while at other times it is retracted toward the interior of the drum by means of the aforesaid reciprocating motion means so as to prevent the occurrence of image noise which is a cause of warping of the drum surface. Electrode 54 may also be grounded rather than having a negative electric potential $V_3$ applied thereto as previously described. When the level of the positive charge is low on the interior surface of the drum with electrode 54 in the grounded state, cleaning of the soil toner can be effectively accomplished by this simple construction. When an electrode plate is substituted for the aforesaid electrode 54, as shown in FIG. 4, and makes contact with the inside of transfer drum 30 opposite brush roller 51, said electrode plate may be electrically grounded or have a negative electric potential $V_3$ bias voltage applied thereto.

The first, second and third modified embodiments of the cleaner of the present invention are described hereinafter with reference to FIGS. 5, 6 and 7.

Figure 5:
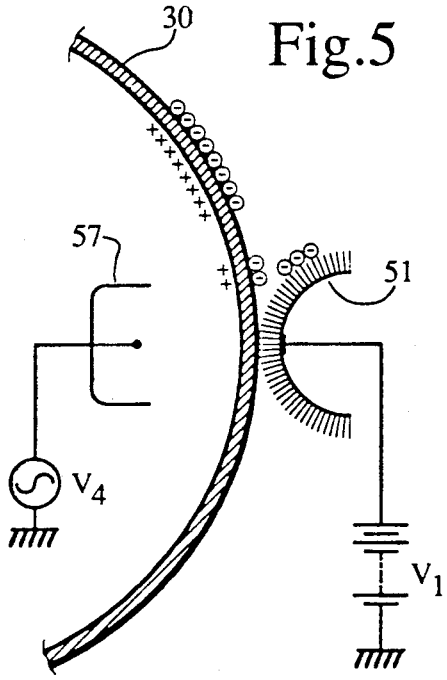
FIG. 5 shows a first modified embodiment of the cleaner of the present invention.

The first modified embodiment shown in FIG. 5 is provided with a charger 57 which confronts brush roller 51 and applies an AC voltage $V_4$ (corresponding to the aforesaid electrode 54) so as to discharge the charge on the interior surface of the drum, and thereby improves the electrostatic attraction of the brush roller 51 as previously described.

Figure 6:
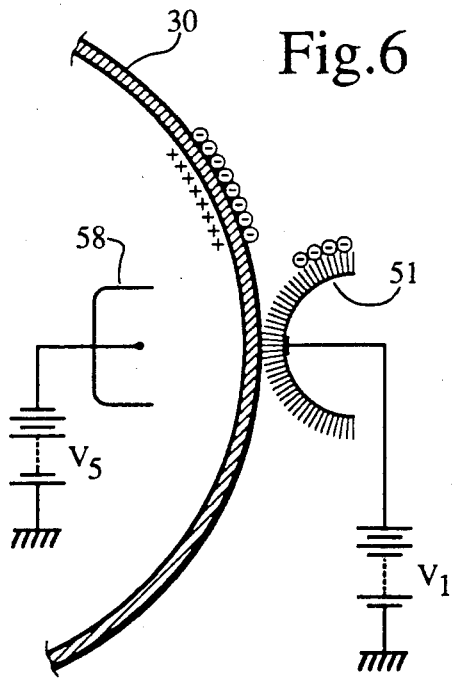
FIG. 6 shows a second modified embodiment of the cleaner of the present invention.

The second modified embodiment shown in FIG. 6 is provided with a direct current (DC) charger 58 which applies a voltage $V_5$ having the same polarity as the soil toner (negative plurality) to the interior of the drum 30, said DC charger 58 (corresponding to the electrode 54) injects a negative charge to the interior surface of the drum, thereby reducing and neutralizing the charge at that location and increasing the electrostatic attraction of the brush roller 51 as previously described. When the output voltage of the DC charger 58 is increased and the interior surface of the drum is in a negatively charged state, the electrostatic attraction of brush roller 51 can be still more improved due to the production of an electric repulsion between the interior and exterior surfaces of the drum.

Figure 7:
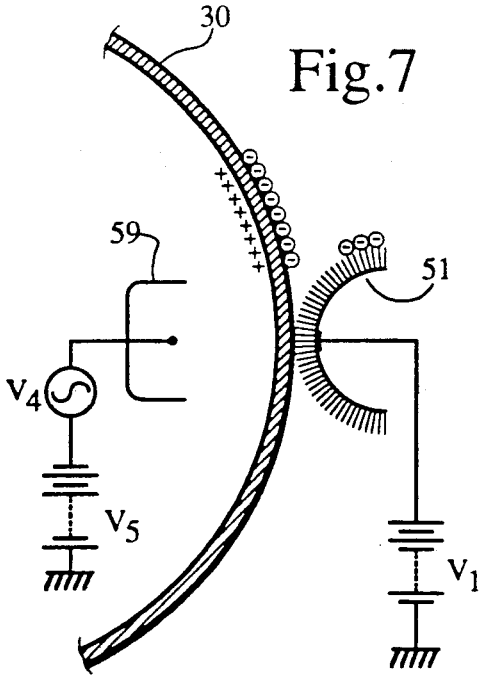
FIG. 7 shows a third modified embodiment of the cleaner of the present invention.

The third modified embodiment shown in FIG. 7 is provided with a discharger 59 in the interior of the transfer drum 30 which can apply the aforesaid AC voltage $V_4$ and DC voltage $V_5$, so that the discharger 59 can actively charge the interior surface of the drum with the same polarity as the exterior surface of the drum, thereby improving the electrostatic attraction of the brush roller 51.

The modified embodiments of the previously described reciprocating means are hereinafter described with reference to FIGS. 8, 9A and 9B.

Figure 8:
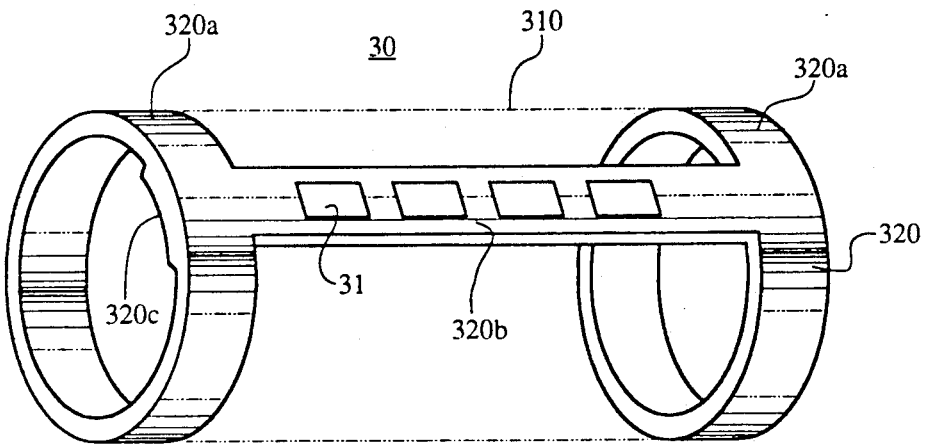
FIG. 8 illustrates the construction of the frame for the transfer drum using a reciprocating motion means to move the electrode provided on the back surface of the transfer drum in the cleaner of the present invention.

As shown in FIG. 8, transfer drum 30 is provided with two cylindrical end portions **320*a* both of which are attached to a connective portion 320*b* to form a drum frame 320 that is covered by a dielectric film 310. Connective portion 320*b* is provided with a chuck claw 31 for stopping the leading edge of the copy sheet. Due to the presence of the chuck claw 31, the connective portion 320*b* is thicker than the dielectric film 310. Accordingly, when a certain degree of rigidity is possessed by the electrode 54 which makes touching contact with the interior surface of drum frame 320, there is a possibility that a drive deficiency or other trouble involving the transfer drum 30 may occur when the aforesaid electrode 54 passes the connective portion 320*b* while in a state of contact therewith. Thus, it is necessary to retract electrode 54 from the transfer drum 30 when said electrode 54 makes contact with the connective portion 320**.

Figure 9B:
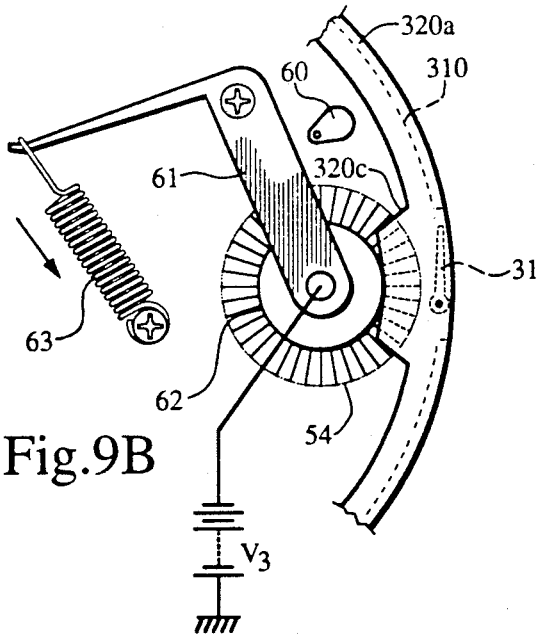
FIG. 9B is a further modification of the modified embodiment of the reciprocating motion means used in the cleaner of the present invention shown in FIG. 9A.
Figure 9A:
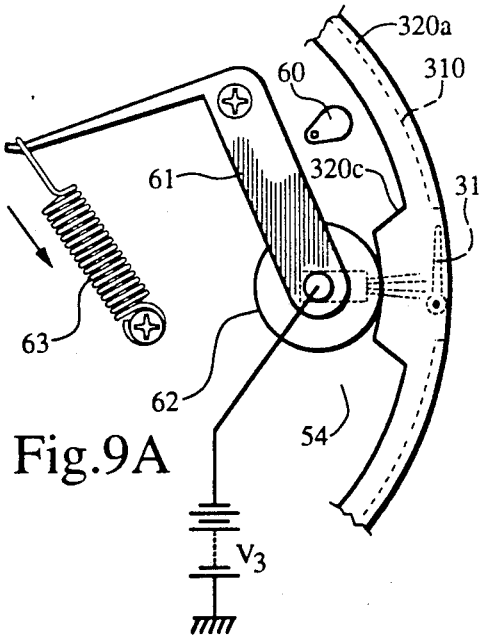
FIG. 9 a illustrates the construction of a modified embodiment of the reciprocating motion means used in the cleaner of the present invention.

In the modified embodiment shown in FIG. 9A, electrode 54 is fixedly attached to a frame 61 and pressed onto the interior surface of the transfer drum 30 by means of a spring 63. Rollers 62 are provided at both ends of electrode 54 and are rotatably supported by frame 61.

On the other hand, a protrusion 320c is provided on the inside of end portion 320a of drum frame 320. Electrode 54 is retracted from transfer drum 30 by means of linking the protrusion 320c and the roller 62 which reciprocally rotates along the interior surface of drum frame end portion 320a with the rotation of transfer drum 30. Cam 60 operates identically to cam 60 shown in FIG. 2 so as to accomplish the contact and release of electrode 54 during cleaning and non-cleaning times. During non-cleaning time, electrode 54 is in the state wherein said electrode is retracted from transfer drum 30 by means of the rotation of the aforesaid cam 60.

FIG. 9B shows a modified embodiment wherein electrode 54 is a brush roller that rotates reciprocally with the rotation of the transfer drum 30 in the construction shown in FIG. 9A. In this embodiment, brush roller 54 as well as cam 62 rotate reciprocally with the rotation of transfer drum 30 so as to minimize the chance of damage to the dielectric film. Other aspects of the mechanism are identical to those described in FIG. 9A.

Although examples of superior cleaning have been heretofore described through the action of the electric field between the backup electrode 54 and the cleaning brush 52 to which a bias voltage is applied, superior cleaning action is also produced by equalizing the charge of the toner on drum 30.

Figure 10:
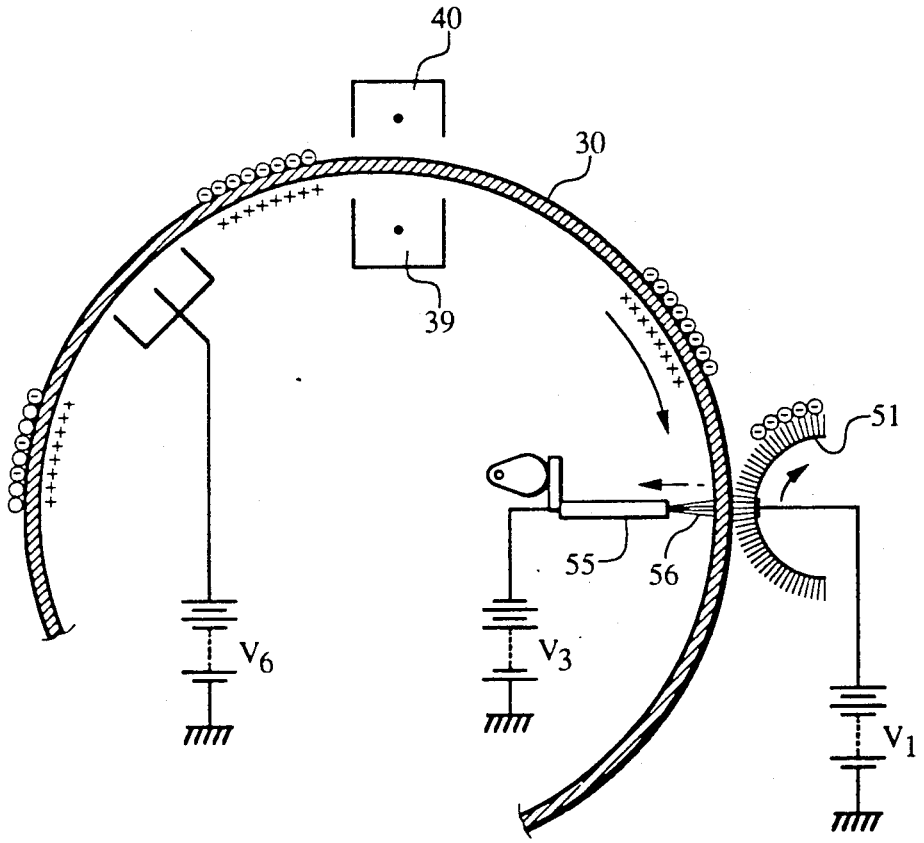
FIG. 10 shows the charge state of the soil toner on the transfer drum used in an embodiment of the present invention.

As shown in FIG. 10, the soiled toner on transfer drum 30 is subjected to discharging by dischargers 39 and 40 during sheet separation so as to induce instability, i.e. nonuniformity, of the charge state. Adhesion of the dispersion toner is also prevalent since instability, i.e. nonuniformity, is also induced in its charge state. Thus, the action of the electric field is inadequate in the cleaning region. In the present embodiment, the soil toner which is in an unstable charge state on the surface of the transfer drum 30 is recharged by the transfer charger to stabilize the charge state of said soil toner and thus accomplish superior cleaning of the transfer drum.

The operation of the cleaner is described in detail hereinafter with reference to FIGS. 11 and 12.

Figure 11:
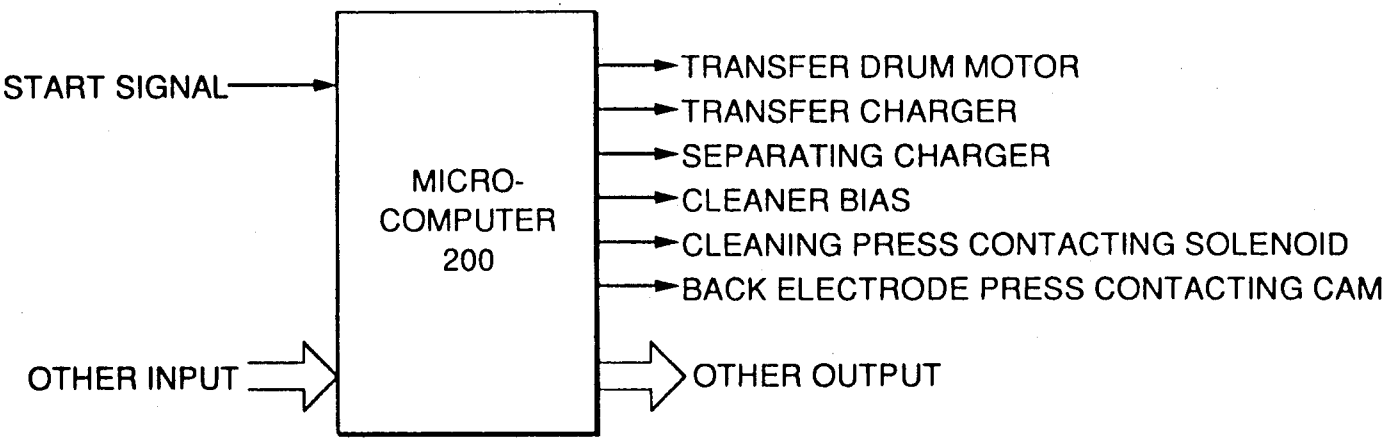
FIG. 11 shows the control circuit of a full color copier using an embodiment of the present invention.
Figure 12:
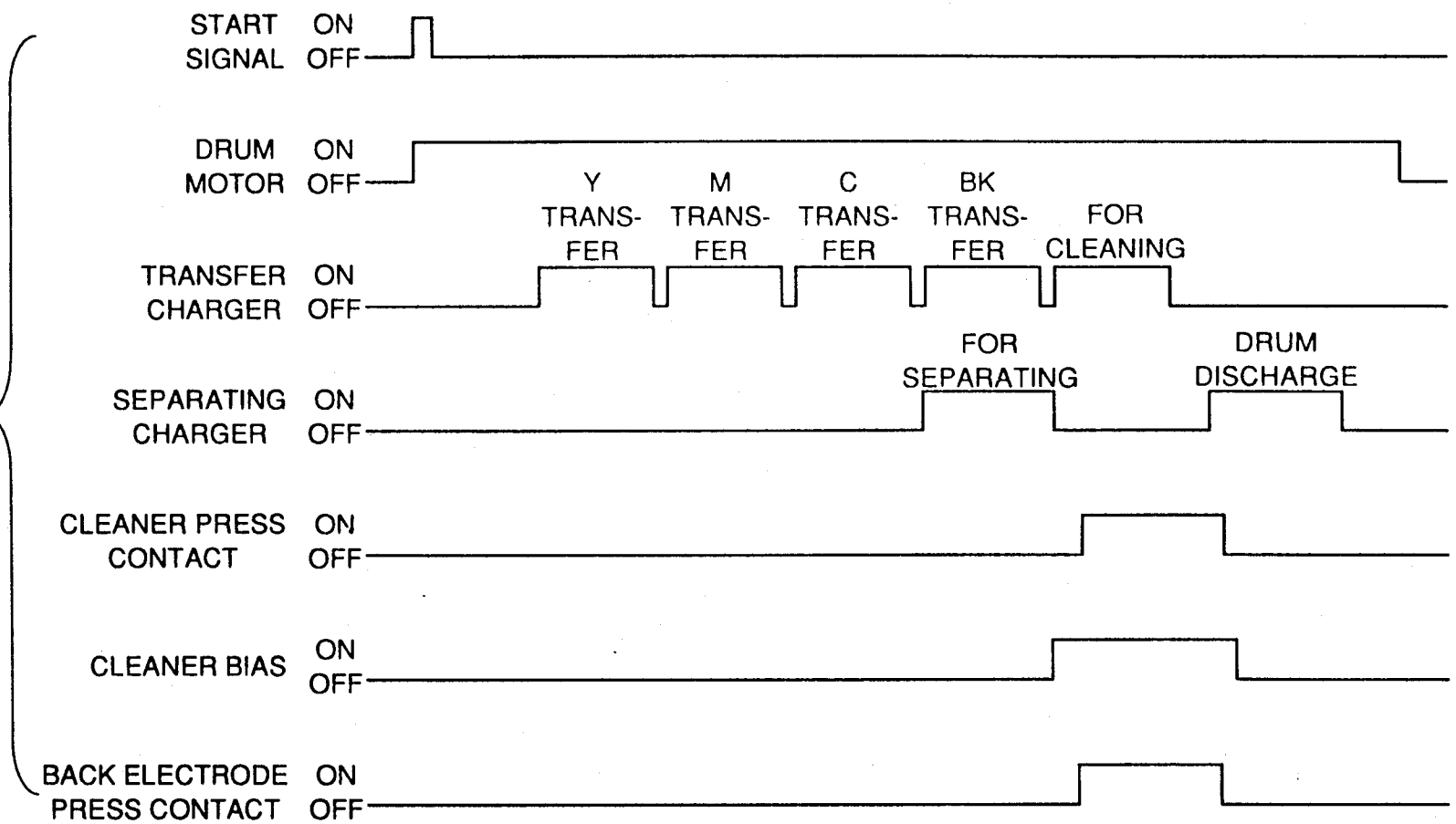
FIG. 12 is a timing chart for the timing control from transfer to cleaning in a full color copier using an embodiment of the present invention.

FIG. 11 is a diagram of the control circuit for the full color copier. Timing control of the copier is accomplished by the programs in microcomputer 200 which receives a start signal, transfer drum standard position signal, paper sensor signals for registration and other input signals, and outputs the transfer drum drive signal, transfer charger, separation charger and cleaning bias voltage ON/OFF switching signals, cleaning brush press solenoid, backup electrode press cam drive signals and other output signals. FIG. 12 is a timing control timing chart. The transfer charger output after the four transfer cycles of Y, M, C and BK, is switched ON to stabilize the charge state of the soil toner on the transfer drum for cleaning. The separation charger on the fourth transfer cycle, and after the sheet is separated from the drum and cleaning is completed, the electrical charge on the surface of the transfer drum is discharged. The cleaner bias is quickly switched ON when the cleaning brush is pressing to achieve superior cleaning. After the previously described transfer process, the transfer charger is switched ON and the soil toner charge is equalized by the separation timing for paper separation from the transfer drum, and thereafter superior cleaning is accomplished by the action of the electric field produced between the electrode 54 and the cleaning brush 51.

Although the general aspects of the embodiments shown in the drawings are as described above, the present invention is suitable for a general cleaner possessing an electrostatic action. That is, a magnetic brush cleaner or insulated brush roller (fur brush) may be substituted for the aforesaid conductive brush roller, electrically charged, and used as a cleaner for scraping away soil toner, and is suitable for use as a conductive cleaning blade, belt type cleaner and web cleaner without using a brush roller.

The cleaner of the present invention is not limited to use in the transfer drum of full color copying machines, and is suitable for general cleaning of a member comprising a surface of dielectric film or synthetic resin grid that does not have a conductive substrate.

According to the above description of the present invention, toner adhering to the drum surface of a member to be cleaned is electrostatically removed from said drum surface, and reliably electrostatically attracted to a cleaning member. Thus, the cleaning capability is remarkably improved.

The present invention differs from conventional cleaners and has a simple construction so is extremely suitable for use in full color copiers.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. In a copying machine having a dielectric substrate to which unnecessary materials may be adhered by electrostatic force, a cleaner for cleaning the surface of the dielectric substrate comprising:

a cleaning means for cleaning the surface of the dielectric substrate by electrically attracting and removing the unnecessary materials on the surface of the dielectric substrate; and an electrode confronting the cleaning means through the dielectric substrate and being movably supported to be in contact and out of contact with the dielectric substrate for weakening the electrostatic force between the unnecessary materials and the surface of the dielectric substrate.

2. In a copying machine having a transfer drum formed of a dielectric substrate to the surface of which toner is temporarily transferred from a photosensitive member to complete toner image on a copy paper and on the surface of which soil toner may be retained by electrostatic force, a cleaner for cleaning the surface of the transfer drum by removing the soil toner comprising:

a cleaning means for cleaning the surface of the transfer drum by electrically attracting and removing the soil toner on the surface of the transfer drum;

an electrode disposed at the interior surface of the transfer drum for weakening the electrostatic force between the soil toner and the surface of the transfer drum; and an electrode position changing means by which said electrode is supported movable from a first position wherein the electrode is in contact with the interior surface of said transfer drum and to a second position wherein the electrode is out of contact therewith by said electrode position changing means.

3. A cleaner as claimed in claim 2, wherein said electrode position changing means comprises a cam for moving the electrode from said first position to said second position by rotation thereof.

4. A cleaner as claimed in claim 2, wherein said electrode position changing means comprises a spring, a frame urged by said spring, a roller provided at the electrode and rotatably supported by the frame, said electrode being moved from said first position to said second position when said roller contacts with a protrusion provided on the inside of the transfer drum.

5. A cleaner provided in a copying machine for cleaning the surface of a dielectric substrate to which unnecessary materials are adhered, which comprises:

cleaning means for cleaning the surface of said dielectric substrate by removing said unnecessary materials on the surface of the dielectric substrate;

an electrode confronting said cleaning means through the dielectric substrate and including a metal substrate and conductive filament which extends from the top of said metal substrate for weakening the electrostatic force between the unnecessary materials and the surface of the dielectric substrate, said electrode being movably supported to be in contact and out of contact with the dielectric substrate.

* * * * *